United States Patent [19]

Schwehr

[11] 4,262,276

[45] Apr. 14, 1981

[54] ADJUSTABLE POTENTIOMETER CONTROL ARRANGEMENT

[75] Inventor: Richard A. Schwehr, Mentor, Ohio

[73] Assignee: Towmotor Corporation, Mentor, Ohio

[21] Appl. No.: 911,846

[22] Filed: Jun. 2, 1978

[51] Int. Cl.[3] ..... H01C 13/00

[52] U.S. Cl. ..... 338/67; 74/96; 74/471 R

[58] Field of Search ..... 338/67; 74/471 R, 96, 74/480 R; 60/433, 434

[56] References Cited

U.S. PATENT DOCUMENTS

| | | | |
|---|---|---|---|
| 2,311,516 | 2/1943 | Brown et al. | 74/471 R |
| 2,460,693 | 2/1949 | Hall | 74/471 R |
| 3,530,736 | 9/1970 | Houk | 74/471 R X |
| 3,864,914 | 2/1975 | Timmins | 74/480 R X |
| 4,047,145 | 9/1977 | Schwehr | 338/67 |
| 4,095,424 | 6/1978 | Laky | 74/471 R X |
| 4,123,740 | 10/1978 | Palmer et al. | 338/67 |

*Primary Examiner*—B. A. Reynolds
*Assistant Examiner*—E. F. Borchelt
*Attorney, Agent, or Firm*—Phillips, Moore, Weissenberger, Lempio & Majestic

[57] ABSTRACT

A handle (12) is pivotally mounted on a support (11) and is connected to a potentiometer (21) by a linkage (24) for selectively varying the resistance of the potentiometer upon manipulation of the handle. The linkage includes a link (25) adjustably connected to the handle for varying the degree of relative movement between a housing (22) and rotary adjustment shaft (23) of the potentiometer to thus vary the range of resistance thereof in response to a same increment of movement of the handle. The linkage may include a hinge assembly (34) and a biasing spring (31) or the link may be connected to the adjustment shaft **(23*b*)** of the potentiometer directly.

11 Claims, 4 Drawing Figures

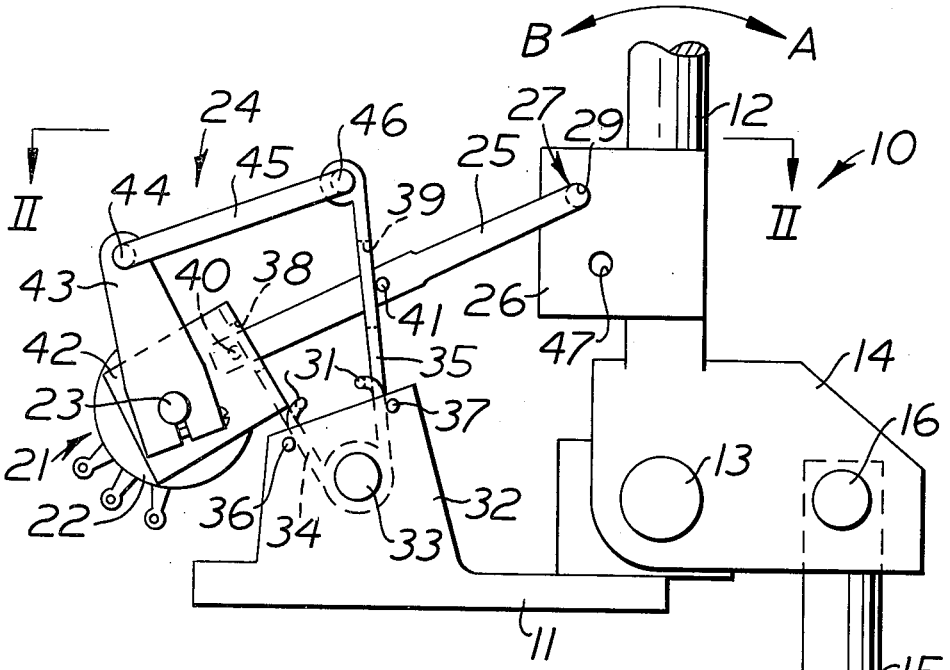
Fig. 1
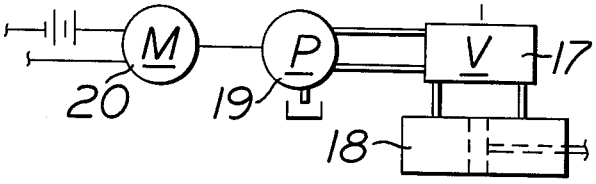
Fig. 2
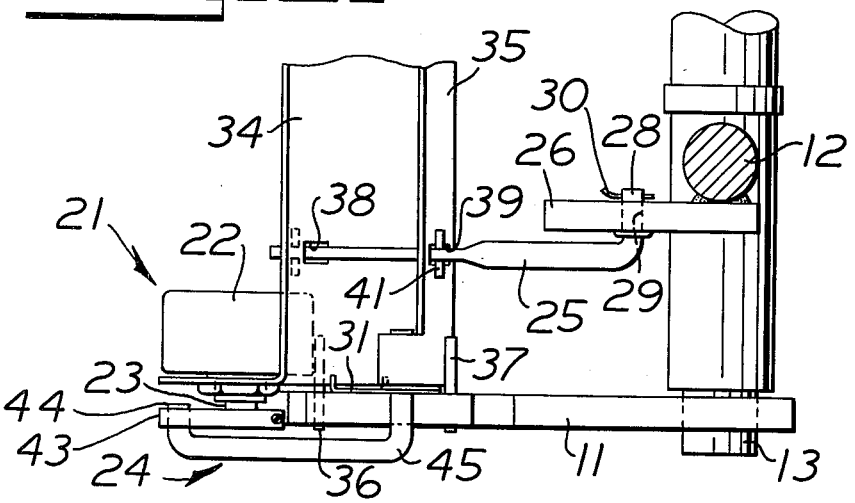

ADJUSTABLE POTENTIOMETER CONTROL ARRANGEMENT

TECHNICAL FIELD

This invention relates to a potentiometer control arrangement for selectively controlling the speed of a motor.

BACKGROUND ART

The operator control circuit for a fork lift truck or the like normally includes a plurality of handles pivotally mounted on a console for selectively effecting the lift, tilt and auxiliary functions of the lift truck. Each handle normally simultaneously actuates a hydraulic control valve and a potentiometer which controls the speed of an electrical motor which, in turn, controls the speed of a pump. The pump is adapted to communicate pressurized fluid to a hydraulic cylinder of the control circuit, through the control valve, for performing a particular work task. A conventional control circuit of this general type is fully disclosed in U.S. Pat. No. 3,962,871, assigned to the assignee of this application.

It has proven desirable to provide adjustment means whereby relative movement between a housing and rotary adjustment shaft of the potentiometer may be varied in response to pivotal movement of a control handle connected thereto. Such adjustment not only facilitates utilization of substantially identical control arrangements for effecting varying ranges of motor speeds, but also permits the operator to readjust a particular motor speed range for a particular work function, if so desired. For example, the operator may want to be afforded the option of a high or relatively low motor speed while utilizing an auxiliary work implement or attachment mounted on the lift truck.

DISCLOSURE OF THE INVENTION

The present invention is directed to overcoming one or more of the problems as set forth above by providing an improved potentiometer control arrangement for controlling the speed of an electrical motor.

In one aspect of this invention, the control arrangement comprises a movable handle and a potentiometer, including a housing and an adjustment member movably mounted relative to the housing, mounted adjacent to the handle. A linkage means is interconnected between the handle and at least one of the housing and adjustment member of the potentiometer for selectively varying the resistance thereof upon movement of the handle. The linkage means includes a hinge assembly pivoted on a support for the handle and a link interconnected between the handle and the hinge assembly. A first memnber of the hinge assembly is connected to the housing of the potentiometer whereas a second member thereof is connected to the adjustable member.

The improved control arrangement of this invention is adapted to precisely control the potentiometer in a highly efficient manner.

BRIEF DESCRIPTION OF THE DRAWINGS

Other objects of this invention will become apparent from the following description and accompanying drawings wherein:

FIG. 1 is a partial side elevational view of a potentiometer control arrangement embodying this invention;

FIG. 2 is a partial top plan view of the control arrangement taken in the direction of arrows II—II in FIG. 1;

BEST MODE FOR CARRYING OUT THE INVENTION (FIGS. 1 AND 2)

Figure 3:
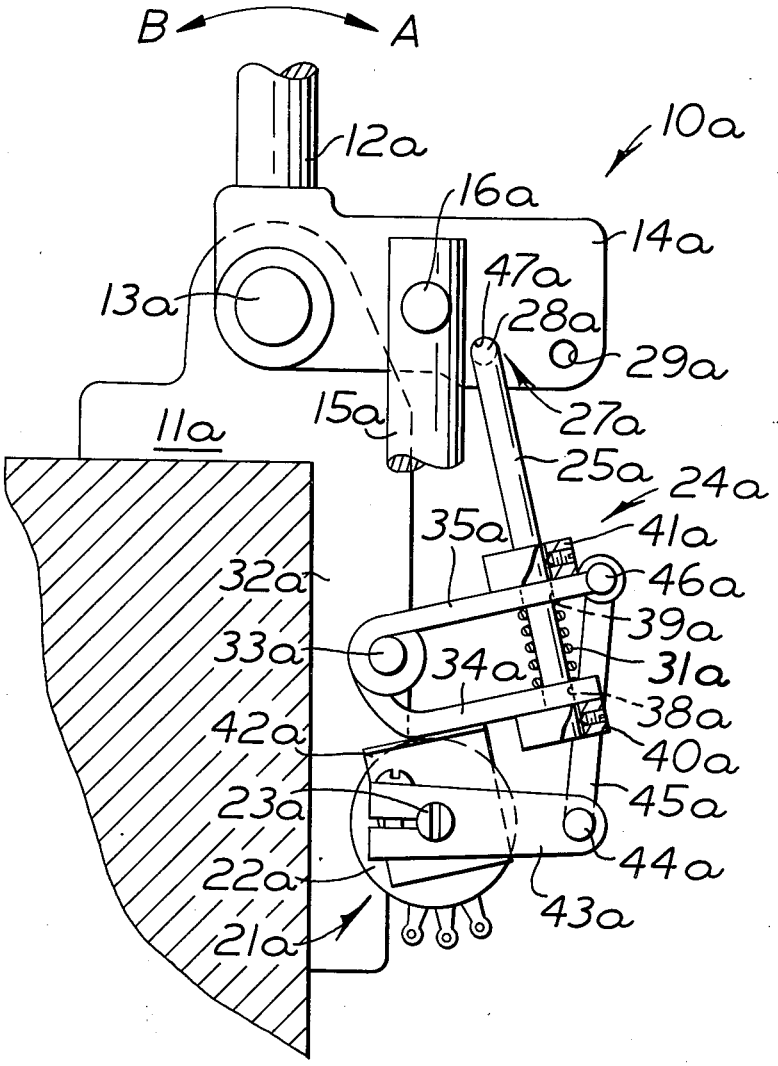
FIG. 3 is a view similar to FIG. 1, illustrating a first modification of the control arrangement.

FIG. 1 illustrates a control arrangement 10 comprising a stationary support bracket 11 having a handle 12 pivotally mounted thereon by a pin 13. An extension 14 of the handle has a valve actuating control rod 15 pivotally mounted thereon by a pin 16. The valve control rod is suitably connected to a control valve 17 for selective actuation thereof upon manipulation of the handle. As disclosed in U.S. Pat. No. 3,962,871, a plurality of such handles may be mounted adjacent to each other for selective actuation by an operator to control the actuation of lift, tilt and auxiliary hydraulic cylinders employed in a control circuit for a lift truck, or the like.

One such cylinder 18 is illustrated for selectively tilting a work implement (not shown) on the truck. As further schematically illustrated, pressurized hydraulic fluid is communicated to the valve from a pump 19, driven by an electrical motor 20. The motor is suitably connected to a potentiometer 21 which is simultaneously actuated, along with valve stem 15, upon pivotal movement of handle 12 by the operator. As described hereinafter, the speed of the motor is responsive to the degree of relative movement occurring between a housing 22 and a rotary adjustment shaft or member 23 comprising the potentiometer whereby the resistance thereof may be varied in proportion to the amount of handle movement.

A linkage means 24 is interconnected between handle 12 and potentiometer 21 for selectively varying the resistance of the potentiometer upon movement of the handle. In this embodiment of the invention, the potentiometer will be actuated upon both clockwise and counterclockwise movement of the handle, about the rotational axis defined by pivot pin 13. The linkage means comprises a link 25 having a first end thereof releasably attached to a second extension or bracket 26 of handle 12 by a releasable connection 27. As shown in FIG. 2, the connection preferably comprises a bent end 28 of rod 25 which is pivotally disposed in an aperture 29, formed through bracket 26, and attached on the bracket by a releasable cotter pin or snap ring 30.

A biasing means in the form of a torsion spring 31 (FIG. 1) has its coils mounted on an upstanding bracket 32, secured on support bracket 11, by a shaft 33 which is affixed to bracket 32. A hinge assembly comprising first and second plates 34 and 35 are pivotally mounted on the shaft and spring biased away from each other by the torsion spring. The hinge plates extend upwardly in diverging relationship relative to each other and are precisely positioned on bracket 32 by stop pins 36 and 37, respectively. Link 25 projects through a pair of elongated slots 38 and 39, formed through plates 34 and 35 of the hinge assembly, respectively. A pair of longitudinally spaced pins 40 and 41 are secured on the link and are disposed on outboard sides of the plates for purposes hereinafter explained.

A bracket 42 is suitably formed as part of plate 34 of the hinge assembly and is secured to housing 22 of potentiometer 21. Shaft 23 has a lower end of a lever 43 secured thereon whereby pivotal movement of the lever will rotate the shaft relative to housing 22 to vary the resistance of the potentiometer. A first end 44 of a second link 45 is pivotally mounted to an upper end of a lever, whereas a second end 46 of such link is pivotally mounted to an upper end of plate 35 of the hinge assembly.

Industrial Applicability (FIGS. 1 and 2)

In operation, pivotal movement of handle 12 in clockwise direction A will move valve control rod 15 downwardly to extend cylinder 18 by communicating pressurized fluid (hydraulic) to the head end thereof and by simultaneously exhausting the rod end thereof. Such movement of the handle will also move link 25 generally rightwardly to, in turn, move plate 34 of the spring-biased hinge assembly rightwardly. Plate 34 will thus engage pin 40 to carry housing 22 of potentiometer 21 rightwardly to cause a relative counterclockwise movement of lever 43 and adjustment shaft 23 to effect the desired speed of motor 20.

The latter movement is achieved due to the relatively stationary disposition of plate 35 of the hinge assembly which abut stationary stop pin 37. Thus, link 45 will remain relatively stationary to effect a counterclockwise movement of lever 43 and adjustment shaft 23 relative to housing 22 of the potentiometer. It should be noted that a relatively large moment arm is provided between the pivot of pin 13 and connection 27 whereby a maximum or relatively large degree of movement is provided between housing 22 and shaft 23 of the potentiometer to thus provide a relatively wide range of motor speeds. As described hereinafter, when connection 27 is relocated at a second aperture 47 formed through bracket 26, a shorter moment arm will result to provide a relatively narrow range of motor speeds.

When the operator desires to retract cylinder 18, handle 12 is moved in counterclockwise direction B in FIG. 1. Such handle movement will function to move valve control rod 15 upwardly to communicate pressurized fluid to the rod end of the cylinder and to exhaust the head end thereof. Simultaneously therewith, the speed of motor 20 will again vary in proportion to the degree of handle movement upon relative rotation between housing 22 and adjustment shaft 23 to the potentiometer. In particular, link 25 will move generally leftwardly to engage pin 41 with plate 35 of the hinge assembly whereby link 45 will also move leftwardly. Such link movement will function to pivot lever 43, and thus adjustment shaft 23 counterclockwise relative to housing 22 whereby the resistance of the potentiometer is selectively varied to control the speed of motor 20.

As suggested above, the operator may adjust linkage means 25 for setting potentiometer 21 at a minimum or relatively small degree of movement between housing 22 and shaft 23. Such adjustment may be affected by releasing cotter pin or snap ring 30 (FIG. 2) from end 28 of link 25 and redisposing this end of the link within second aperture 47. Upon replacement of snap ring 30 on the rod, control arrangement 10 is conditioned to function in substantially the same manner as described above, but with a resulting minimum or relatively small degree of relative rotary movement being afforded between lousing 22 and shaft 23 of the potentiometer, i.e., less than maximum degree of movement afforded when the rod is attached within aperture 29. As indicated above, such reduced degree of relative movement is occasioned since the moment arm between the axes of pivot pin 13 and connection 27 has been shortened.

Figure 4:
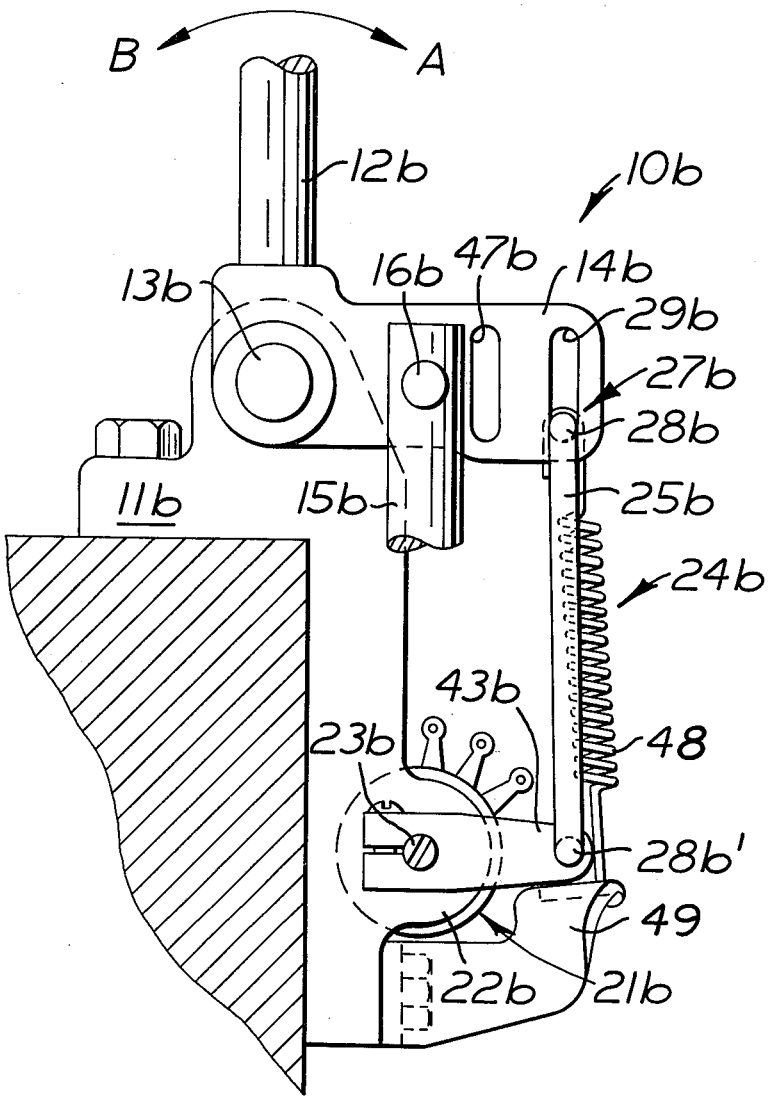
FIG. 4 is a similar view, illustrating a second modification of the control arrangement.

Additional Modes For Carrying Out the Invention (FIGS. 3 and 4)

FIGS. 3 and 4 illustrate first and second modifications **10*a* and 10*b* of the control arrangement wherein identical numerals depict corresponding constructions, but wherein the numerals appearing in FIGS. 3 and 4** are accompanied by an "a" and "b", respectively.

Second Mode (FIG. 3)

Referring to FIG. 3, control arrangement **10*a* comprises a stationary support bracket 11*a* having a handle 12*a* pivotally mounted thereon by a pin 13*a*. Extension 14*a* of the handle has a valve actuating control rod 15*a* pivotally mounted thereon by a pin 16*a* . Rod 15*a*** is operatively connected to a valve in the manner aforedescribed.

Control arrangement **10*a* functions similar to control arrangement 10 in that movement of handle 12*a* in either direction A or B will function to actuate potentiometer 21*a* which comprises a housing 22*a* and a rotary adjustment shaft or member 23*a*. The potentiometer is operatively connected to extension 14*a* by a releasable connection 27*a*. In a manner similar to that described above, first and second apertures 29*a* and 47*a* are formed in the extension to alternately receive an end 28*a* of a link 25*a* to provide adjustment means whereby minimum (47*a*) and maximum (29*a***) settings of the potentiometer may be achieved.

Linkage means **24*a* further comprises a hinge assembly comprising hinge plates 34*a* and 35*a* which are pivotally mounted on a shaft 33*a*, anchored to a portion 32*a* of bracket 11*a*. Hinge plates 34*a* and 35*a* have link 25*a* reciprocally mounted in aligned apertures 38*a* and 39*a* formed therethrough, respectively. A pair of axially spaced collars 40*a* and 41*a* are fixedly secured to link 25*a* and are dispoed on outboard sides of hinge plates 34*a* and 35*a*, respectively. A bracket 42*a* is secured to housing 22*a* of the potentiometer and plate 34*a*, whereas a lever 43*a* is secured to adjustment shaft 23*a*. It should be noted that housing 22*a* is disposed in unsecured relationship relative to portion 32*a* of bracket 11*a***.

A second link **45*a* is pivotally interconnected between lever 43*a* and plate 35*a* of the hinge assembly by pins 44*a* and 46*a*, respectively. A compression coil spring 31*a*** is disposed between the plates of the hinge assembly to bias them away from each other.

Industrial Applicability (FIG. 3)

In operation, clockwise pivoting of handle **12*a* in direction A will function to move valve control rod 15*a* downwardly along with link 25*a*. A valve similar to valve 17 (FIG. 1) would thus be actuated in the aforedescribed manner whereby downward movement of the link will function to move collar 41*a* against plate 35*a* of the hinge assembly to, in turn, move link 45*a* downwardly. Lever 43*a* and adjustment shaft 23*a* will thus pivot clockwise relative to housing 22*a* of the potentiometer whereby the speed of motor 20 (FIG. 1) may be closely controlled and varied within a relatively narrow range (as compared with attachment of link 25*a* within aperture 29*a***).

Counterclockwise pivotal movement of handle **12*a* in direction B will function to move valve control rod 15*a* and link 25*a* upwardly. Upon upward movement of the link, collar 40*a* will engage plate 34*a* to pivot it generally counterclockwise. Since the housing of potentiometer 21a is secured to plate 34a**, *link 45a* will react to pivot lever 43a and adjustment shaft 23a counterclockwise relative to housing 22a. Thus, the same relative movement will occur between the housing and adjustment shaft of the potentiometer whether handle 12a is moved in either direction A or B.

When end 28a of link 25a is connected within aperture 47a, the potentiometer will be at its minimum setting whereby a relatively small degree of rotary movement is provided between housing 22a and shaft 23a. For example, aperture 47a may be utilized for connection purposes with link 25a when control rod 15a is associated with a control valve for actuating a tilt cylinder of a lift truck which requires a relatively lower range of motor speeds. Aperture 29a could be employed when rod 15a is associated with control valve for selectively actuating the cylinder employed for auxiliary equipment requiring a relatively high potentiometer and motor speed setting.

Third Mode (FIG. 4)

Referring to FIG. 4, control arrangement 10b comprises a support bracket 11b having a handle 12b pivotally mounted thereon by a pin 13b. An extension 14b of the handle pivotally mounts a valve actuating control rod 15b thereon by a pin 16b. As described hereinafter, the valve actuating control rod may be operatively connected to a control valve for controlling the selective extension of a lift cylinder for a lift truck, for example.

A potentiometer 21b has its housing 22b fixedly secured to an extension of stationary support bracket 11b and has an adjustment shaft 23b rotatably mounted therein. A linkage means 24b comprises a link 25b detachably mounted on handle extension 14b by a releasable connection 27b of the type above-described. An upper end 28b of the link is mounted within an elongated slot 29b, formed through the extension of the handle and is spring biased downwardly by a tension coil spring 48 interconnected between the rod end and a stationary bracket 49 secured to support bracket 11b. A lower end 28b' of rod 25b is pivotally connected to a lever 43b, having adjustment shaft 23b of the potentiometer secured thereto.

Industrial Applicability (FIG. 4)

In operation, counterclockwise pivoting of handle 12b in direction B, about the axis of pin 13b, will function to move valve actuating control rod 15b and link 25b upwardly. Upward movement of the link will, in turn, pivot lever 43b and adjustment shaft 23b of the potentiometer counterclockwise, relative to housing 22b. The disposition of rod end 28b in slot 29b will provide a maximum setting for the potentiometer when compared to the minimum setting provided by a second slot 47b which defines a shorter moment arm between the pivot axes of pin 13b and rod end 28b when the rod end is disposed in such slot.

It should be further noted that clockwise pivotal movement of handle 12b in direction A will actuate rod 15b to move it downwardly, but will not affect potentiometer 21b. In particular, rod end 28b will move upwardly in lost motion slot 29b and lever 43b will be held in contact with bracket 49 which provides a stop means limiting clockwise pivotal movement of the lever. This control arrangement is particularly adapted for use with the lift cylinder employed for lowering and raising the mast of a fork lift truck wherein the mast is raised by extension of the cylinder upon communication of pressurized fluid thereto, but is allowed to lower under the influence of gravity without the aid of pressurized fluid.

Other aspects, objects and advantages of this invention can be obtained from a study of the drawings, the disclosure and the appended claims.

What is claimed is:

1. A potentiometer control arrangement comprising a handle (12,12a) movably mounted on a support (11,11a), a potentiometer (21,21a), including a housing (22,22a) and an adjustment member (23,23a) mounted for relative movements thereon, mounted adjacent to said handle, and linkage means (24,24a) interconnected between said handle and at least one of the housing and adjustment member of said potentiometer for selectively varying the resistance thereof upon movement of said handle, said linkage means comprising a hinge assembly (34,35,34a,35a) connected to the housing of said potentiometer and a link (25,25a) interconnected between said handle and said hinge assembly, said hinge assembly being pivotally mounted on said support and comprising first (34,34a) and second (35,35a) members with said first member being connected to the housing of said potentiometer and said second member being connected to the adjustable member thereof.

2. The control arrangement of claim 1 wherein the adjustment member of said potentiometer comprises a shaft (23,23a) rotatably mounted on the housing thereof and wherein said linkage means further comprises a lever (43,43a) secured to said shaft.

3. The control arrangement of claim 1 further comprising a valve actuating control rod (15,15a) pivotally connected to said handle and adapted for connection to a valve (17) for simultaneous actuation along with said potentiometer upon movement of said handle.

4. The control arrangement of claim 1 wherein said first and second members comprise first and second plates, respectively, and further comprising first (40,40a) and second (41,41a) stop means secured on said link and disposed on outboard sides of said first and second plates, respectively, for alternately moving said plates in response to movement of said link.

5. The control arrangement of claim 1 further comprising a lever (43,43a) secured to the adjustable member of said potentiometer and a second link (45,45a) pivotally interconnected between said lever and the second plate of said hinge assembly.

6. The control arrangement of claim 1 further comprising a stop means (36,37) secured on said support and disposed on an outboard side of each of the first and second plates of said hinge assembly for limiting movement thereof.

7. The control arrangement of claim 1 further comprising biasing means (31,31a) disposed between the first and second plates of said hinge assembly for urging them away from each other.

8. The control arrangement of claim 1 further including adjustment means (28,29,47,28a,29a,47a) for selectively changing the position of said linkage means between said handle and said potentiometer for varying the degree of relative movement between the housing and the adjustment member of said potentiometer in response to a same increment of movement of said handle.

9. The control arrangement of claim 8 wherein said adjustment means comprises connection means (28,28*a*) releasably connecting said link to said handle.

10. The control arrangement of claim 9 wherein said adjustment means comprises a plurality of apertures (29,47,29*a*,47*a*) formed in an extension (26,14*a*) of said handle for alternately connecting said link therein by said connection means.

11. The control arrangement of claim 10 wherein said handle is pivotally mounted on said support for pivotal movement about an axis and wherein said apertures are spaced from said axis at different distances to provide different moment arms between said apertures and said xis.

* * * * *